United States Patent [19]

Mizuno et al.

[11] 4,442,812

[45] Apr. 17, 1984

[54] METHOD AND APPARATUS FOR CONTROLLING INTERNAL COMBUSTION ENGINES

[75] Inventors: Toshiaki Mizuno, Nagoya; Mitsunori Takao, Kariya, both of Japan

[73] Assignee: Nippondenso Co., Ltd., Kariya, Japan

[21] Appl. No.: 322,913

[22] Filed: Nov. 19, 1981

[30] Foreign Application Priority Data

Nov. 21, 1980 [JP] Japan ..... 55-164230

[51] Int. Cl.[3] ..... F02D 5/00; F02D 37/02

[52] U.S. Cl. ..... 123/417; 123/424; 123/480; 123/491; 123/179 B

[58] Field of Search ..... 123/416, 417, 422, 423, 123/424, 480, 486, 491, 492, 493, 179 A, 179 B, 179 G; 364/431.04, 431.05, 431.10

[56] References Cited

U.S. PATENT DOCUMENTS

| | | | |
|---|---|---|---|
| 4,184,458 | 1/1980 | Aoki et al. | 123/480 |
| 4,197,767 | 4/1980 | Leung | 123/436 |
| 4,214,306 | 7/1980 | Kobayashi | 123/480 |
| 4,223,644 | 9/1980 | Latsch et al. | 123/489 |
| 4,232,643 | 11/1980 | Leshner et al. | 123/440 |
| 4,245,605 | 1/1981 | Rice et al. | 123/492 |
| 4,257,377 | 3/1981 | Kinugawa et al. | 123/480 |
| 4,271,798 | 6/1981 | Seitz et al. | 123/419 |
| 4,286,560 | 9/1981 | Sagisaka et al. | 123/416 |
| 4,322,800 | 3/1982 | Hisegawa et al. | 364/431.05 |
| 4,327,689 | 5/1982 | Rachel | 123/436 |
| 4,329,960 | 5/1982 | Woodhouse et al. | 123/436 |
| 4,348,728 | 9/1982 | Sagisaka et al. | 364/431.06 |
| 4,359,993 | 11/1982 | Carlson | 123/492 |
| 4,364,349 | 12/1982 | Miyagi et al. | 123/491 |

*Primary Examiner*—Andrew M. Dolinar

*Attorney, Agent, or Firm*—Cushman, Darby & Cushman

[57] ABSTRACT

A control method for an internal combustion engine equipped with an electronically controlled fuel injection system in which at least one of the control variables of the engine is corrected in accordance with engine speed and intake pressure. The amounts of change in speed and pressure are computed at intervals of a given period, and a basic control variable value is corrected in accordance with the amounts of the change. Under specific operating conditions of the engine including the start of the engine, the correction process is inhibited.

14 Claims, 8 Drawing Figures

METHOD AND APPARATUS FOR CONTROLLING INTERNAL COMBUSTION ENGINES

BACKGROUND OF THE INVENTION

1. Field of the Invention

The present invention relates to a method and an apparatus for controlling internal combustion engines equipped with an electronically controlled fuel injection system and more particularly to a method and an apparatus for controlling internal combustion engines, which employ electronic control circuitry to control fuel injection quantity, ignition timing, etc., so as to stably control engine rotational speeds at the time of idling and a low speed operation of the engines without adverse effects on other efficiencies thereof.

2. Description of the Prior Art

In a known type of internal combustion engine (hereinafter simply referred to as an engine equipped with a speed-density type electronic fuel injection system, either basic fuel injection quantity is determined with a two-dimensional map in accordance with engine speed and intake pipe pressure, or the basic fuel injection quantity obtained by applying engine speed compensation to the fuel injection quantity determined in accordance with intake pipe pressure. In either case, the fuel quantity causes the air-fuel mixture to substantially satisfy a stoichiometric air-fuel ratio, and such basic fuel injection quantities are further compensated for variations in the cooling water temperature, intake air temperature, battery voltage, etc., thereby providing a resultant controlled fuel injection quantity.

However, the above-mentioned basic fuel quantity is determined principally from the value of the intake pipe pressure, and the effect of the engine speed thereon is small as compared with that of the intake pipe pressure.

If any disturbance is applied to an engine operating under a no load condition, not only are the engine speed and the intake pipe pressure varied, but also the fuel injection quantity is varied substantially in phase with the variation of the intake pipe pressure for the above-mentioned reason. However, in the case of an engine equipped with a speed-density type electronic fuel injection system, the intake system has a large-capacity surge tank and this gives rise to a phase difference between the engine rotational speed and the intake pipe pressure. Consequently, a phase difference appears between the engine rotational speed and the fuel injection quantity. As a result, if the engine rotational speed decreases, the air-fuel ratio becomes leaner and the torque decreases, which, in turn, further decreases the engine rotational speed. On the contrary, if the engine rotational speed increases, the air-fuel ratio becomes richer and the torque increases, and this results in a further increase in the engine rotational speed. Thus, there is involved a disadvantage that the variation of the engine rotational speed is enhanced and the engine rotational speed becomes unstable.

To overcome the foregoing disadvantage, it has been proposed to adjust the air-fuel ratio characteristic around the idling operation on the basic of a certain predetermined intake pipe pressure (an average idling intake pipe pressure of a large number of engines) in such a manner that when the engine rotational speed becomes higher than a predetermined idling speed and the intake pipe pressure becomes lower than the predetermined intake pipe pressure, the basic fuel injection quantity is compensated to enrich the air-fuel mixture, whereas when the intake pipe pressure becomes higher than the predetermined intake pipe pressure, the compensation is effected to make the air-fuel mixture leaner. However, even if the basic fuel injection quantity is compensated on the basis of such a predetermined intake pipe pressure in such a manner that the mixture is enriched when the intake pipe pressure becomes lower than the predetermined pressure and the mixture is made leaner when the reverse is the case, the intake pipe pressure during an idling operation differs for every engine due to variations in performance of the respective engines. Therefore, it is impossible to expect an identical functional effect on all manufactured engines when they are put on the market. In addition, after the engines have been put to practical use, the intake pipe pressure during an idling operation varies due to the wear and secular variation or changes over time of an idling intake air flow rate, with the resultant deterioration of the stability of the idling operation and the exhaust emission. Further, with vehicles of the type employing an exhaust emission control system comprising an oxygen concentration sensor feedback system including a three-way catalyzer, even if the basic fuel injection quantity is compensated for variations in the intake pipe pressure with respect to the previously mentioned predetermined intake pipe pressure, the stability of an idling operation will be deteriorated considerably due to variations of the air-fuel ratio caused by the feedback action. Further, if the capacity of the surge tank is increased to increase the engine output, the phase difference between the engine speed and the fuel injection quantity will also be increased thus making the engine rotational speed unstable, and after all making it practically impossible for the prior art methods to overcome these defects.

The present invention has been made in view of the foregoing defects involved in the prior art.

SUMMARY OF THE INVENTION

It is an object of the present invention to provide a method and apparatus for controlling an engine equipped with an electronic fuel injection system by correcting at least one control variable in accordance with at least one operating parameter of the engine. In the present invention, the amount of a change of at least one operating parameter is computed at intervals of a given time period or a given engine crank angle and the at least one control variable is corrected in accordance with the amount of the change. The proportion of the change is determined in accordance with either the amount of the change and the magnitude of the operating parameter, or the rate of an incremental change of the amount of the change, or the proportion of the change obtained at intervals of a given time period or a given engine crank angle, thereby preventing variations of the engine rotational speed during periods of idling and low speed operation. The correction control of the at least one control variable is inhibited at the time the engine is started, or at the start and during a predetermined time period after the start or at the start and until a predetermined integrated number of revolutions of the engine is reached thereby preventing adverse effects on the starting performance. The conditions for effecting the correction control are limited in accordance with engine rotational speeds and intake pipe pressures thereby to prevent the deterioration of the accelerability of the engine and further to eliminate adverse effects caused by variations in the performance among respective engines, wear of the engine, a change over time of an idling intake air flow rate of the engine, etc.

DESCRIPTION OF THE PREFERRED EMBODIMENTS

Figure 1:
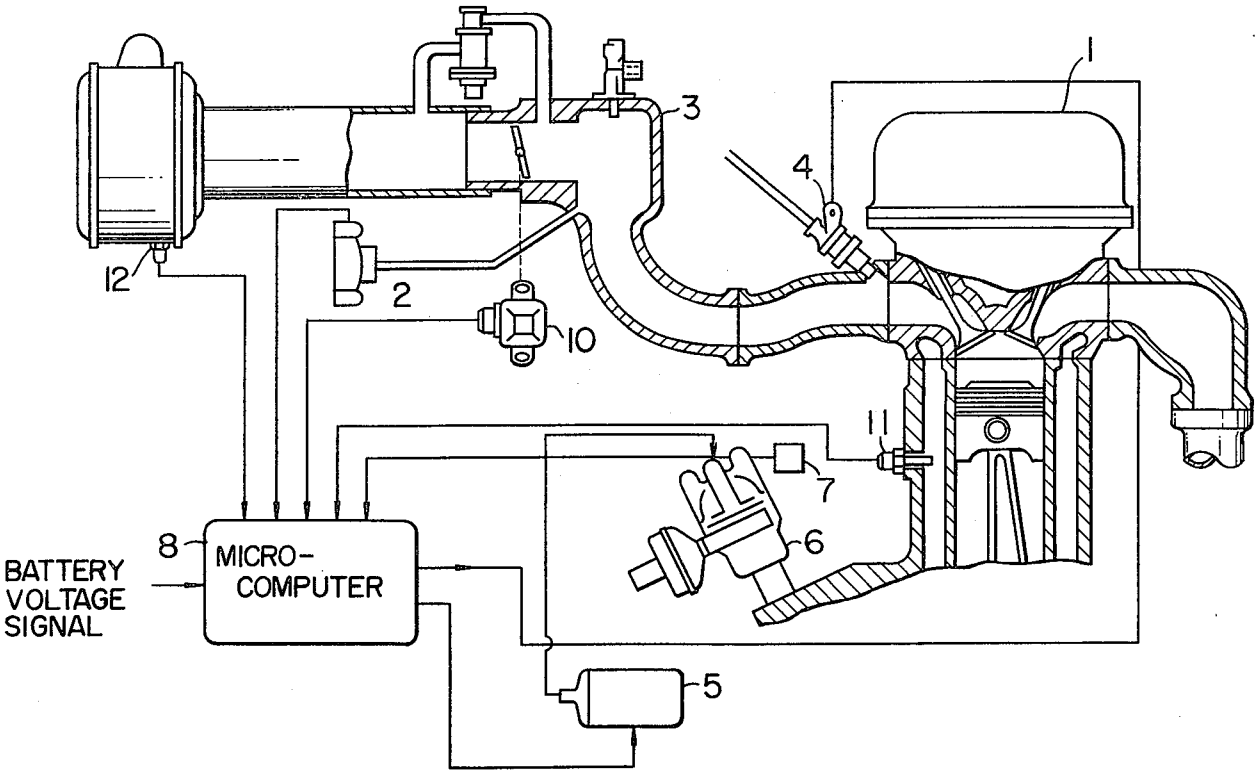
FIG. 1 is a schematic diagram showing a six-cylinder engine and its control apparatus for performing a control method according to the present invention.

The present invention will now be described in greater detail with reference to an embodiment illustrated in the accompanying drawings. FIG. 1 illustrates the construction of a six-cylinder engine 1 and its control system to which the control method according to the present invention has been applied. In the Figure, numeral 2 designates a semiconductor type intake pipe pressure sensor for sensing a pressure within an intake manifold 3, and 4 an electromagnetically operated fuel injection valve disposed in the intake manifold 3 near each of intake ports of the cylinders of the engine 1, to which fuel under a controlled pressure is forced. Numeral 5 designates an ignition coil which is a part of the ignition system, and 6 a distributor for distributing the ignition energy produced by the ignition coil 5 to spark plugs arranged in the respective cylinders. As is well known in the art, the distributor 6 is rotated once for every two revolutions of the engine crankshaft and it contains therein a rotational angle sensor 7 for sensing an engine rotational angle.

Numeral 9 designates a throttle valve of the engine 1, and 10 a throttle sensor for sensing that the throttle valve 9 is closed fully or substantially fully. Numeral 11 designates a cooling water temperature sensor for sensing the state of warming-up of the engine 1, and 12 an intake air temperature sensor for sensing the temperature of air taken into the engine 1.

Numeral 8 designates a microcomputer for computing the magnitude and timing of engine control signals, and it is responsive to the signals from the intake pipe pressure sensor 2, the rotational angle sensor 7, the throttle sensor 10, the cooling water temperature sensor 11 and the intake air temperature sensor 12 as well as to a battery signal to compute the quantity of fuel supplied to the engine 1 through the fuel injection valves 4 and the ignition timing of the engine 1 on the basis of the above-mentioned signals.

Figure 2:
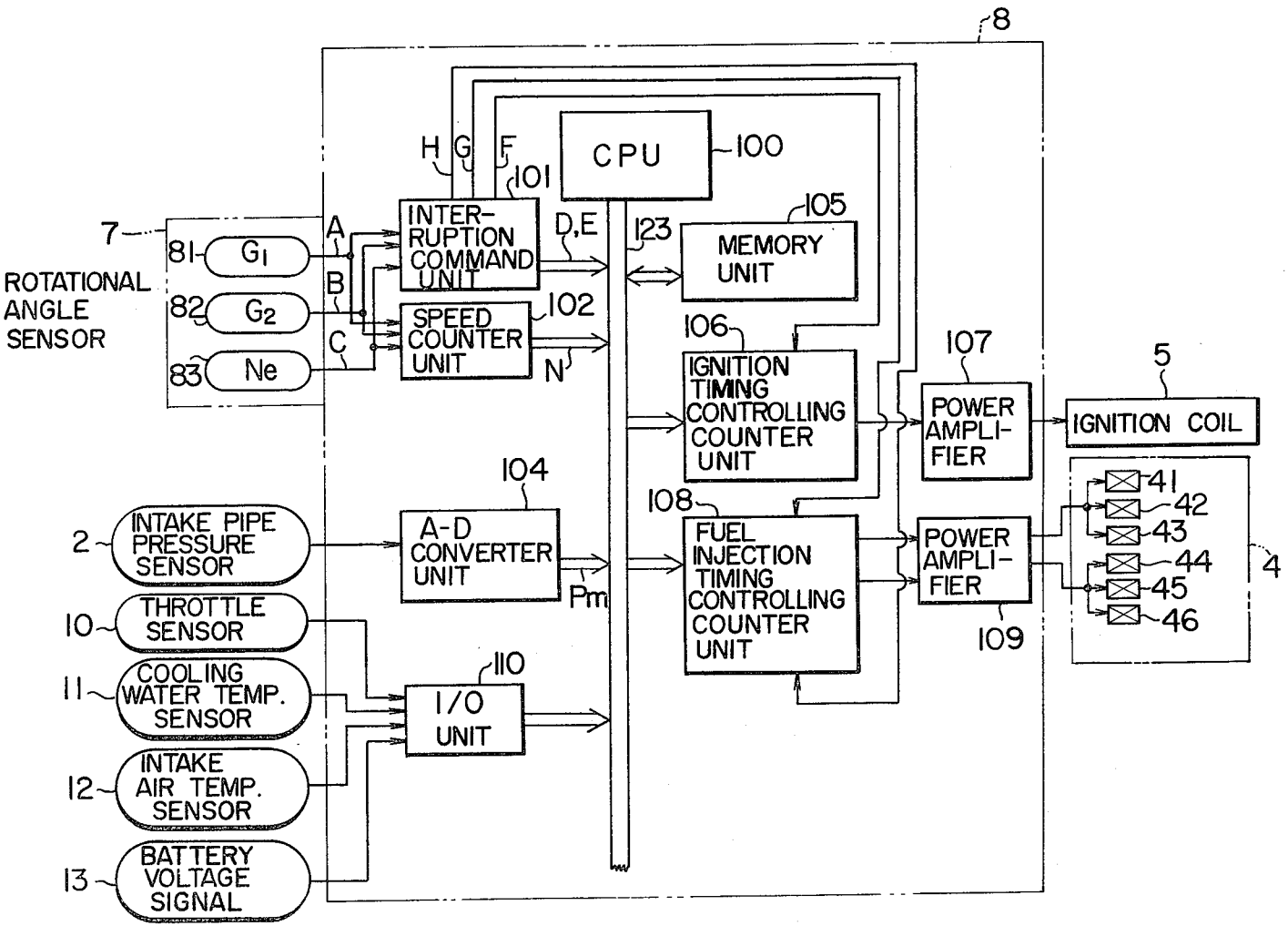
FIG. 2 is a block diagram showing the construction of the microcomputer shown in FIG. 1.

FIG. 2 is a block diagram for explaining in detail the construction of the microcomputer 8. In the Figure, numeral 100 designates a microprocessor unit (CPU) for performing interruption operation to compute the fuel injection quantity and the ignition timing. Numeral 101 designates an interruption command unit responsive to the rotational angle signals from the rotational angle sensor 7 contained in the distributor 6 to command the microprocessor unit 100 to perform the interruption operations for the computation of the fuel injection quantity and the ignition timing, respectively, with the data being transmitted to the microprocessor unit 100 via a common bus 123. The interruption command unit 101 also generates necessary timing signals for controlling the operation starting timing of units 106 and 108 which will be described later. Numeral 102 designates a speed counter unit responsive to the rotational angle signals from the rotational angle sensor 7 and the clock signals having a predetermined frequency which is supplied from the microprocessor 100 to count the period of a predetermined rotational angle and compute the engine speed. Numeral 104 designates an A-D converter unit which operates to subject the signal from the intake pipe pressure sensor 2 to A-D conversion and to make the microprocessor unit 100 read the resultant digital signals. Numeral 110 designates an input/output unit through which the output signals from the throttle sensor 10, the cooling water temperature sensor 11 and the intake air temperature sensor 12 as well as the battery voltage signal are received, converted to digital signals and then delivered. Numeral 105 designates a memory unit storing a control program for the microprocessor unit 100 and also storing the output date of the units 101, 102, 104 and 110. The transmission of data between the memory unit 105 and the microprocessor unit 100 is effected via the common bus 123. The output data from the units 102, 104 and 110 are transmitted to the microprocessor unit 100 or the memory unit 105 via the common bus 123. Numeral 106 designates an ignition timing controlling counter unit including a register whereby digital signals respectively indicative of the point where the ignition coil 5 is energized and the point where the ignition coil 5 is de-energized (or the ignition timing) computed by the microprocessor unit 100 are computed in terms of a time interval and a time point respectively corresponding to engine rotational angles (crank angles). Numeral 107 designates a power amplifier for amplifying the output signal from the ignition timing controlling counter unit 106 and controlling the time points where the ignition coil 5 is energized and de-energized, respectively, the latter time point being the ignition timing of the engine 1. Numeral 108 designates a fuel injection duration controlling counter unit including registers, and it comprises two down-counters having the same function which operate respectively to convert the digital signal indicative of the duration of opening of the fuel injection valves 4, namely, the fuel injection quantity computed by the microprocessor unit 110 to a pulse signal having a pulse time width which determines the opening time period of the fuel injection valves 4. Numeral 109 designates a power amplifier which receives and amplifies the output pulse signals from the counter unit 108 and supplies the resultant amplified signals to the fuel injection valves 4, and it comprises two channels in correspondence to the construction of the counter unit 108.

As shown in FIG. 2, the rotational angle sensor 7 comprises three sensors 81, 82 and 83. The first rotational angle sensor 81 is constructed so that an angle signal A is generated at a position $\theta$ degrees before 0° crank angle once at every two revolutions of the engine crankshaft (or one revolution of the distributor 6) as shown by the waveform in (A) of FIG. 3. The second rotational angle sensor 82 is constructed so that an angle signal B is generated at a position $\theta$ degrees before 360° crank angle once at every two revolutions of the engine crankshaft as shown by the waveform in (B) of FIG. 3. The third rotational angle sensor 83 is constructed so that angle signals of the same number as the engine cylinders are generated at equal intervals. That is, in the case of a six-cylinder engine as the present embodiment, six angle signals C are generated at intervals of 60 degrees at every revolution of the engine crankshaft, starting at 0° crank angle as shown by the waveform in (C) of FIG. 3.

The interruption command unit 101 is responsive to the respective angle signals (or the respective crankshaft rotational angle signals) from the rotational angle sensors 81, 82 and 83 to generate signals D and E for commanding an interruption operation for computing the ignition timing and an interruption operation for computing the fuel injection quantity, respectively. That is, the frequency of the angle signals C from the third rotational angle sensor 83 is divided by a factor of 2 so that an interrupt command signal D is generated starting from just after the generation of the angle signal A from the first rotational angle sensor 81 as shown in (D) of FIG. 3. The interrupt command signal D is generated six times at every two crankshaft revolutions, that is, the interrupt command signals D of the same number as the engine cylinders are generated at every two crankshaft revolutions, and thus in the case of a six-cylinder engine the interrupt command signal D is generated at intervals of 120° crank angle to command an interruption for computing the ignition timing to the microprocessor unit 100. Also, the interruption command unit 101 divides the frequency of the angle signals C from the third rotational angle sensor 83 by a factor of 6 such that an interrupt command signal E is generated in response to the sixth signals C after the generation of the angle signals A and B from the first rotational angle sensor 81 and the second rotational angle sensor 82, respectively, that is, the signal E is generated at intervals of 360° (one crankshaft revolution) starting at 300° crank angle, as shown in (E) of FIG. 3, and the interrupt command signal E commands an interruption for computing the fuel injection quantity to the microprocessor unit 100.

Figure 4A:
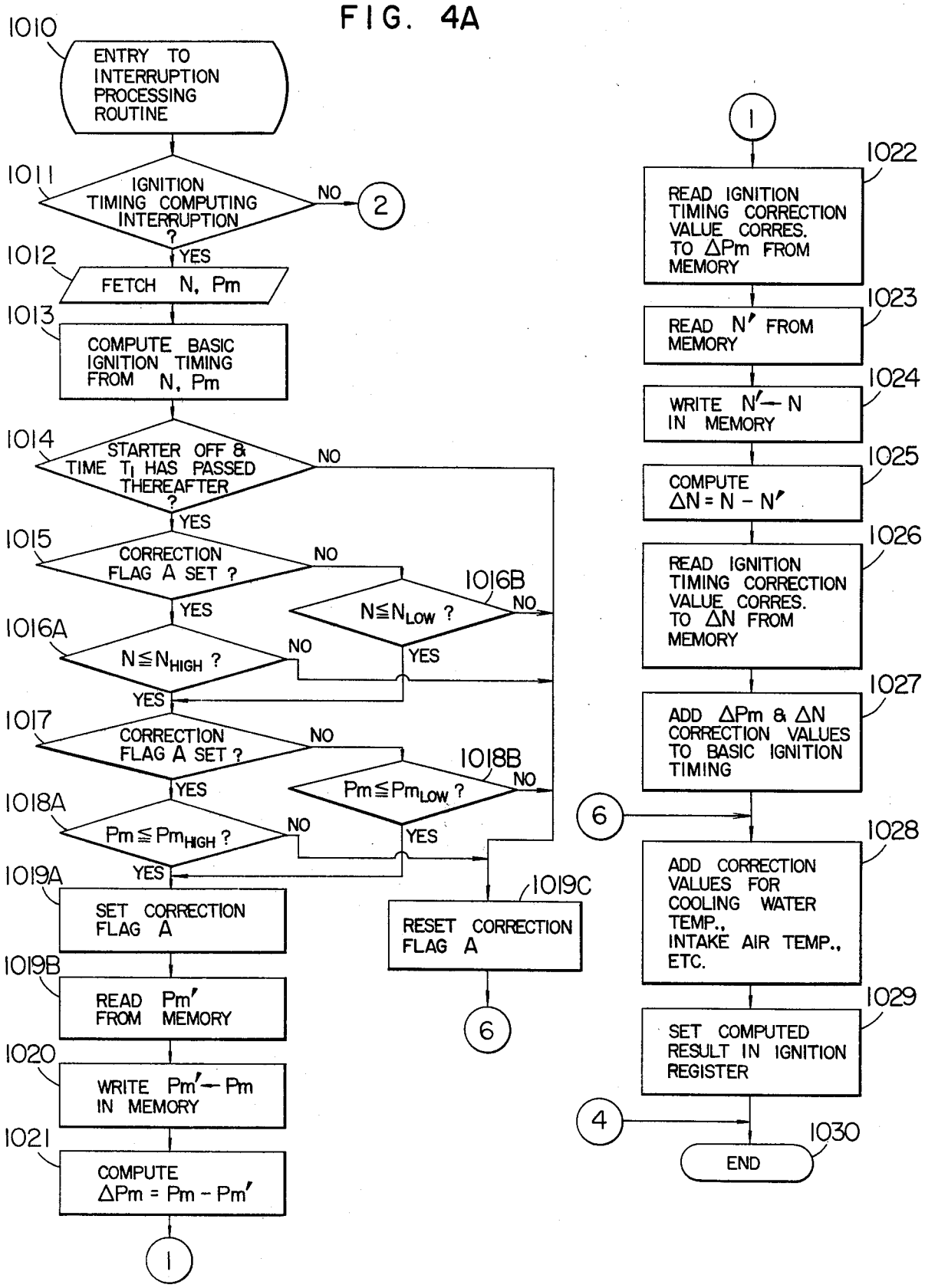
FIGS. 4A and 4B, which are to be referred to in combination, show, by way of example, a schematic flow chart of the interruption operations performed by the microcomputer for making basic ignition timing and basic fuel injection quantity corrections.
Figure 4B:
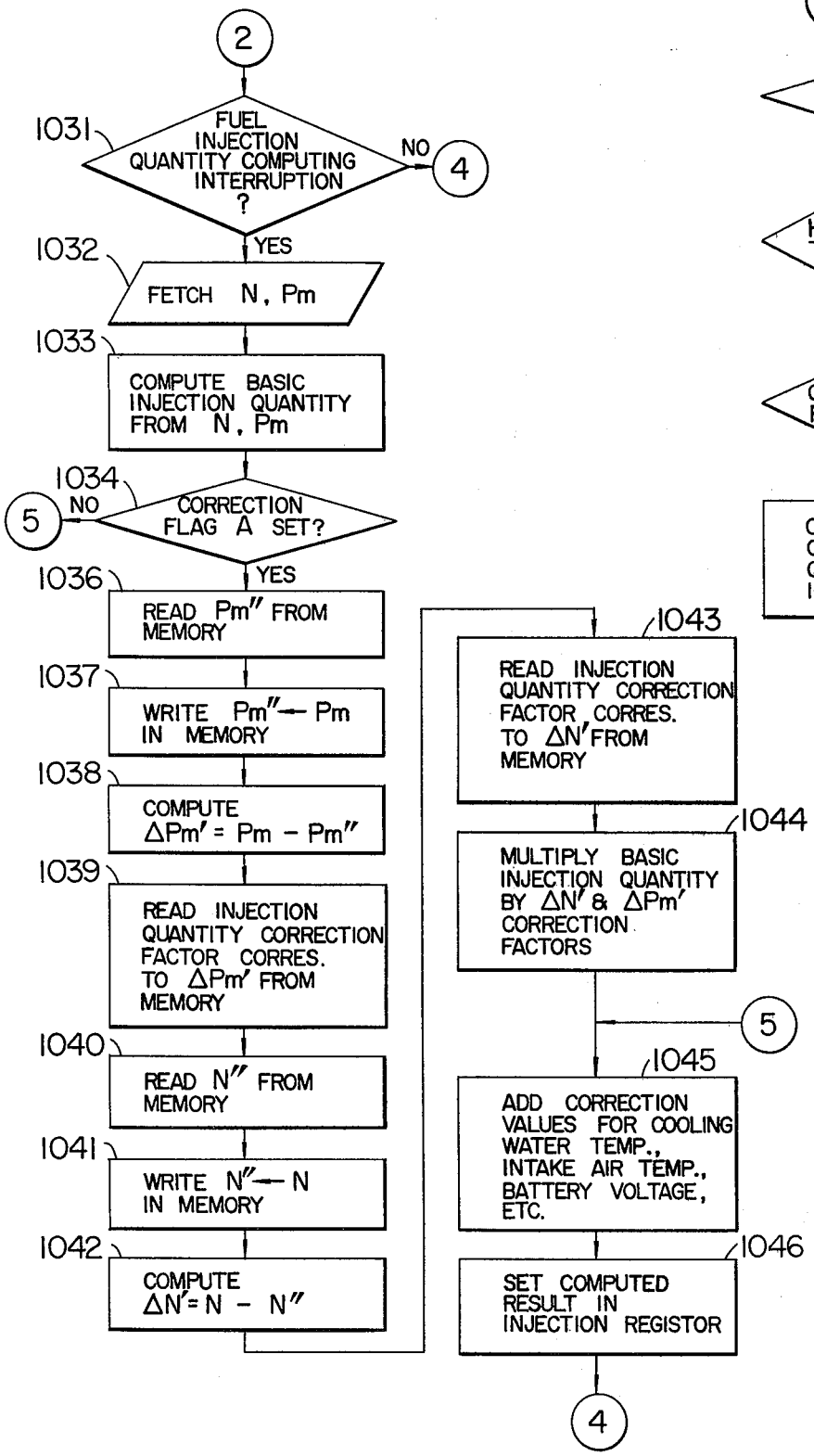

FIGS. 4A and 4B are a schematic flow chart showing the computing operations performed by the microprocessor unit 100. The function of the microprocessor unit 100 will now be described with reference to the flow chart shown in FIGS. 4A and 4B which are to be referred to in combination.

Figure 3:
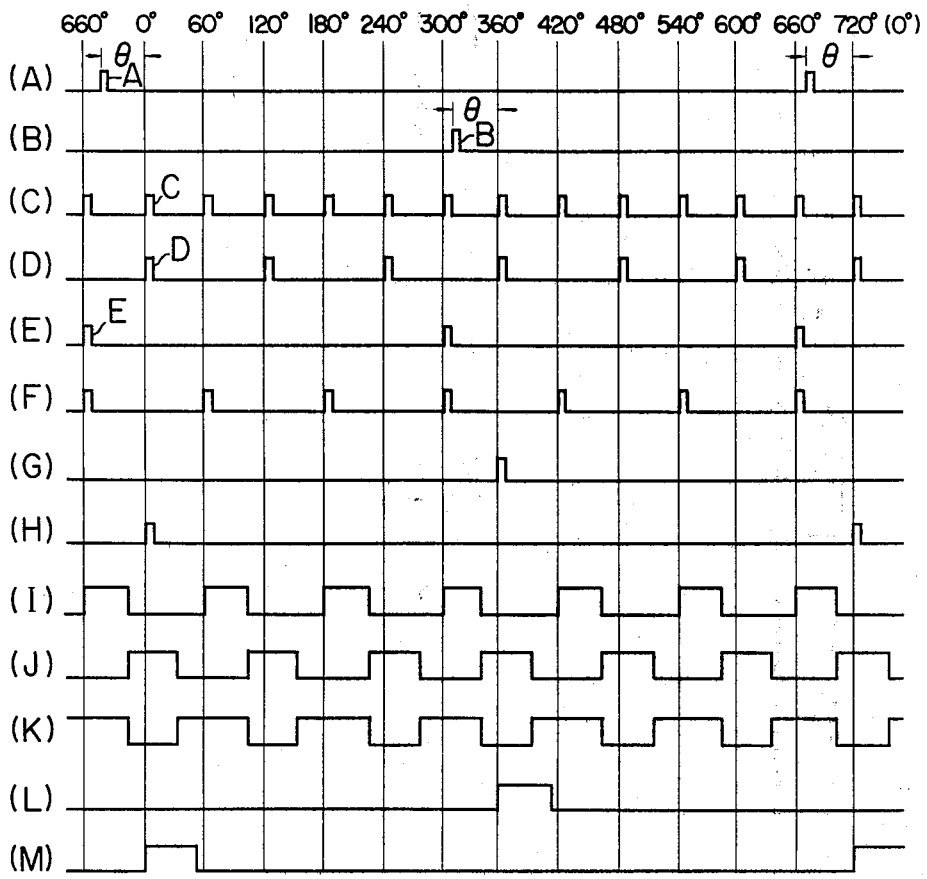
FIG. 3 shows a plurality of signal waveforms for use in explaining the operation of the control apparatus shown in FIG. 1.

When the engine is started and the ignition timing computing interruption command signal D or the fuel injection quantity computing interruption command signal E shown in (D) or (E) of FIG. 3, respectively, is applied to the microprocessor unit 100 from the interruption command unit 101, even if the main routine is being processed, the microprocessor unit 100 immediately interrupts the processing of the main routine and the control is transferred to the interruption processing routine which starts at a step 1010 in FIG. 4A.

When the command signal D for the ignition timing interruption processing is applied to the microprocessor unit 100, the control is transferred from a step 1011 to a step 1012 which fetches an engine speed indicative signal N generated by the speed counter unit 102 and an intake pipe pressure indicative signal Pm generated by the A-D converter unit 104 from an RAM area in the memory unit 105, and then a step 1013 computes a corresponding basic injection timing in accordance with a two-dimensional map for the values of N and Pm which is stored in an ROM area of the memory unit 105.

Thereafter, the computation of correction values for the basic ignition timing is conducted in accordance with the operating conditions of the engine and in response to variations in the operating parameters of the engine. As one of the features of this invention, the next step 1014 determines whether the starter is off and a time longer than a time period $T_1$ has elapsed from the turning-off of the starter, and if it is true, the processing proceeds to a step 1015. If it is not true, the processing proceeds to a step 1019C where no correction is effected and a correction flag A is reset. The step 1015 determines whether the correction control indicative flag A has been set to indicate that the control is in operation. If it is true, the processing proceeds to a step 1016A where the engine speed N, which has been fetched, is compared with a control stopping engine speed $N_{HIGH}$. If the comparison results in $N \leqq N_{HIGH}$, the processing proceeds to a step 1017. If $N > N_{HIGH}$, the processing proceeds to the step 1019C, and the correction control is interrupted. If the step 1015 determines that the correction flag A is not set, the processing proceeds to a step 1016B where the engine speed N, which has been fetched, is compared with a control starting engine speed $N_{LOW}$. If $N \leqq N_{LOW}$ holds, the processing proceeds to the step 1017. If $N > N_{LOW}$, the processing proceeds to the step 1019C, and no correction control is effected. The steps 1015, 1016A and 1016B can provide the control stopping engine speed with a hysteresis characteristic, which forms one of the features of the present invention. In the like manner, the steps 1017, 1018A and 1018B can give a hysteresis characteristic to a control stopping pressure for the intake pipe pressure Pm which has been fetched.

Then, the processing proceeds to a step 1019A where the correction flag A for indicating whether the correction control of the engine control variables, namely, the ignition timing and the fuel injection quantity, is possible or not is set in a state indicating that the correction is possible. A step 1019B reads a signal P'm indicative of the intake pipe pressure, which was used in the preceding ignition timing interruption processing, from the RAM area of the memory unit 105 into the microprocessor unit 100. A step 1020 writes the signal Pm, which was fetched in the step 1012, in the RAM area of the memory unit 105 in place of the signal P'm. The Pm thus written is used as the signal P'm in the next ignition timing interruption processing. A step 1021 computes a change of the intake pipe pressure, $\Delta Pm = Pm - P'm$. A step 1022 reads an ignition timing correction value corresponding to the intake pipe pressure change $\Delta Pm$ from the map of the ignition timing correction quantity versus the intake pipe pressure which is stored in the ROM area of the memory unit 105. Then, the operations similar to those conducted through the steps 1019B, 1020, 1021 and 1022 with respect to the intake pipe pressure Pm are conducted through steps 1023, 1024, 1025 and 1026 with respect to the engine speed N, and an ignition timing correction value corresponding to an engine speed change ΔN is read from the map of the ignition timing correction quantity versus the engine speed which is stored in the ROM area of the memory unit 105. A step 1027 adds the ignition timing correction values corresponding to ΔPm and ΔN to the basic ignition timing. A step 1028 adds the correction values for the cooling water temperature, intake air temperature, etc., to the ignition timing which was corrected by the correction values corresponding to ΔPm and ΔN in the step 1027, and then a step 1029 sets the resultant ignition timing computation data in the register of the ignition timing controlling counter unit 106. The above-mentioned ignition timing interruption processing ends in a step 1030.

On the other hand, when the interruption command signal E for the fuel injection quantity in the EFI system is applied to the microprocessor unit 100, even if the main routine is being processed, the microprocessor unit 100 immediately interrupts the processing of the main routine and the processing is transferred to the interruption processing routine which comprises the step 1010 in FIG. 4A and the following, and the processing proceeds from the step 1011 in FIG. 4A to a step 1032 in FIG. 4B via a step 1031 in FIG. 4B. The step 1032 in FIG. 4B performs the same operation as the step 1012 in FIG. 4B and fetches an engine speed signal N and an intake pipe pressure Pm. A step 1033 in FIG. 4B computes a basic fuel injection quantity in accordance with the engine speed signal N and the intake pipe pressure signal Pm fetched in the step 1032. Thereafter, the computation of correction values for the basic fuel injection quantity is conducted in accordance with the operating conditions of the engine and in response to variations in the operating parameters of the engine. If a step 1034 determines that the correction flag A has been set by the latest ignition timing interruption processing, the processing proceeds to a step 1036. The operations similar to those conducted through the steps 1019B, 1020, 1021, 1022, 1023, 1024, 1025 and 1026 are conducted through the steps 1036, 1037, 1038, 1039, 1040, 1041, 1042 and 1043 thereby to compute basic injection quantity correction factors corresponding to an intake pipe pressure change ΔPm′ and an engine speed change ΔN′. A step 1044 multiplies the basic fuel injection quantity by the correction factors corresponding to ΔPm′ and ΔN′, respectively. A step 1045 makes corrections on this fuel injection quantity for variations in the cooling water temperature, intake air temperature, battery voltage, etc., and a step 1046 sets the resultant computation data in the register of the fuel injection duration controlling counter unit 108. Then, the processing proceeds to the step 1030 in FIG. 4A, thereby completing the above-mentioned fuel injection quantity interruption processing.

A description will now be made of the maps for use in the correction of the basic ignition timing and fuel injection quantity in accordance with the amount of the change of the intake pipe pressure and that of the engine speed, which maps are stored beforehand at the respective designated locations in the ROM area of the memory unit 105.

Figure 5:
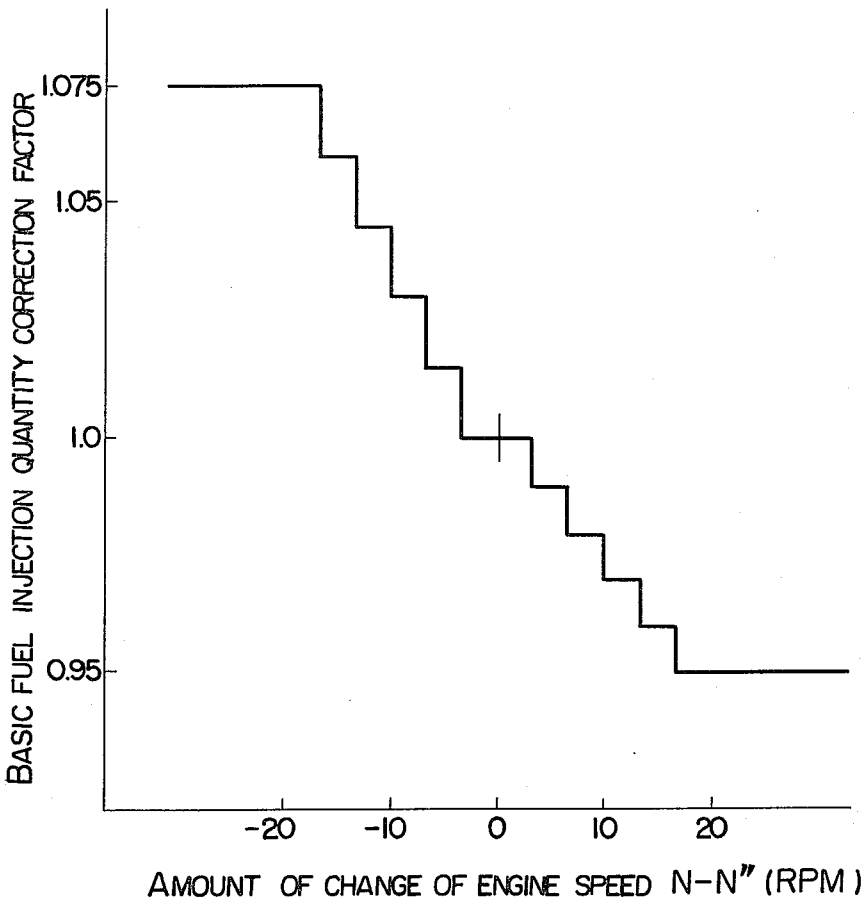
FIG. 5 shows, by way of example, a characteristic data map stored preliminarily in the memory unit of the microcomputer of FIG. 1 and used to correct the basic fuel injection quantity in accordance with the amount of a change of the engine speed.

The fuel injection quantity correction factors with respect to the amount of the changes of the engine rotational speed are stored preliminarily at the predetermined locations in the ROM area of the memory unit 105 in the form of a map containing characteristic data as shown in FIG. 5, for example. More specifically, when the engine rotational speed decreases and hence the amount of the change of the engine rotational speed is negative, the fuel injection quantity is corrected in a direction to be increased thereby to raise a torque generated by the engine and hence to prevent a further drop in the engine rotational speed. On the contrary, when the engine rotational speed increases and hence the amount of the change of the engine rotational speed is positive, the fuel injection quantity is corrected in a direction to be decreased so that a torque generated by the engine is decreased and the engine speed is prevented from being elevated further. Further, since the engine torque characteristic around the stoichmetric air-fuel ratio is such that, assuming that the same amount of variation of the air-fuel ratio occurs on both lean and rich sides of the stoichiometric ratio, a decrease of the torque caused by the variation of the air-fuel ratio on the lean side becomes greater than an increase of the torque caused by the variation of the air-fuel ratio on the rich side, the correction factors for variations of the engine rotational speed in the negative direction are set to be greater than those for variations of the engine speed in the positive direction.

Figure 6:
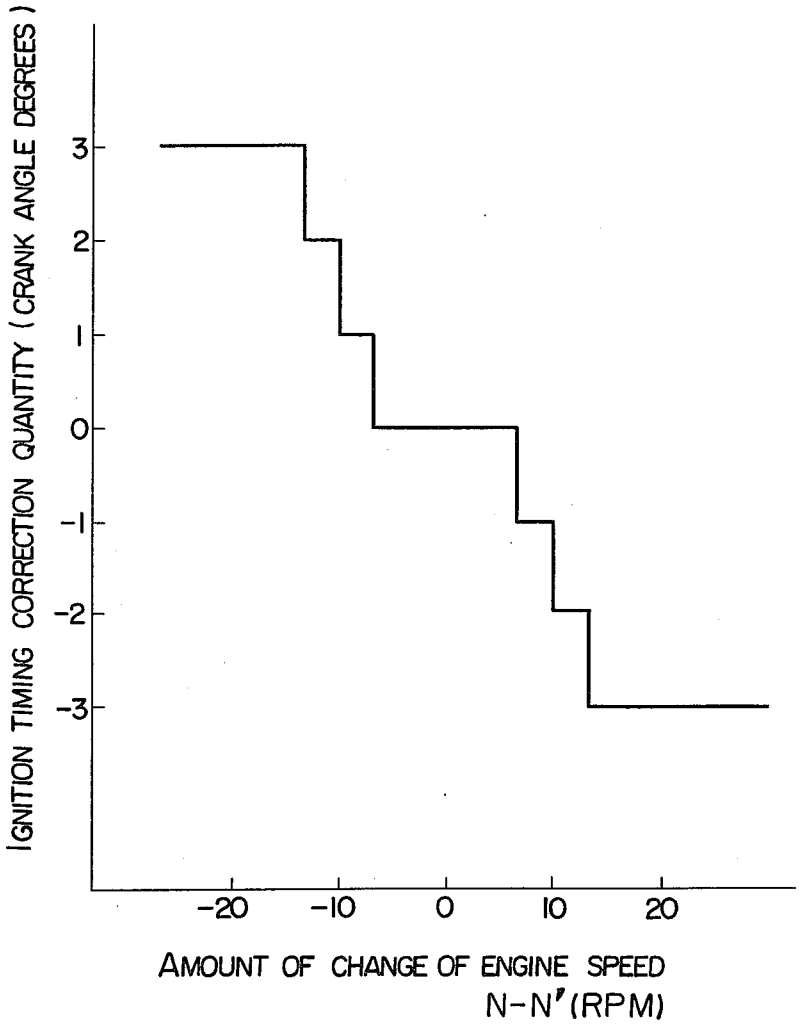
FIG. 6 shows, by way of example, a characteristic data map stored preliminarily in the memory unit of the microcomputer of FIG. 1 and used to correct the ignition timing in accordance with the amount of a change of the engine speed.

Next, the ignition timing correction values with respect to the amount of the change of the engine rotational speed are stored preliminarily at the designated locations in the ROM area of the memory unit 105 in the form of a map containing characteristic data as shown in FIG. 6, for example. More specifically, if the engine rotational speed decreases and hence the amount of the change of the engine rotational speed is negative, the ignition timing is shifted in a direction to be advanced thereby increasing a torque generated by the engine and preventing the engine rotational speed from decreasing further. On the contrary, when the engine rotational speed increases and hence the amount of the change of the engine speed is positive, the ignition timing is shifted in a direction to be retarded so that a torque generated by the engine is decreased and the engine rotational speed is prevented from increasing further.

The correction values for the basic fuel injection quantity and ignition timing with respect to the amount of the change of the intake pipe pressure may be determined in a manner similar to the case with respect to the amount of the change of the engine rotational speed.

While, in the embodiment described above, the engine rotational speed control is commenced upon elapse of a predetermined time after the start of the engine (namely, the turning-off of the starter motor), or after a predetermined integrated number of engine revolutions has been reached, it is possible to inhibit the engine rotational speed control only during the start of the engine and to commence the control immediately upon completion of the start of the engine (namely, the turning-off of the starter motor).

While the above-described embodiment of the invention relates to six-cylinder engines equipped with a speed-density type electronic fuel injection system, the invention is, of course, applicable to other multi-cylinder engines such as four-cylinder engines, eight-cylinder engines, etc. as well as to multi-cylinder engines equipped with a mass-flow type electronic fuel injection system.

Figure 7:
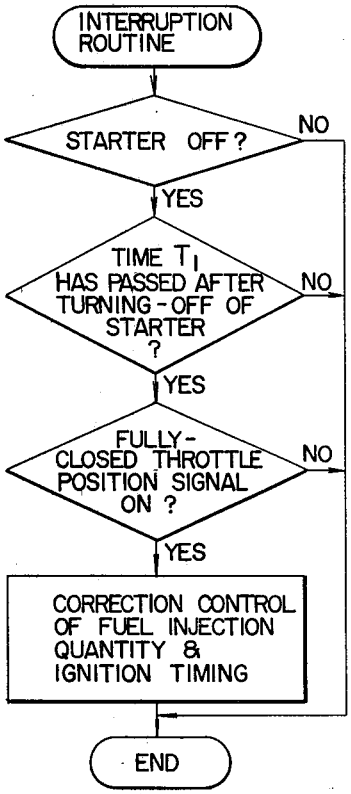
FIG. 7 shows, by way of example, a flow chart of the processing steps for inhibiting the control according to this invention by detecting whether the throttle valve is fully closed after the lapse of a predetermined time from the start of the engine.

Further, while, in the above-described embodiment of the invention, the control is effected by detecting an engine operating condition around the idling speed in accordance with the intake pipe pressure and the engine rotational speed, it may be possible to inhibit the control of this invention by detecting the fully-closed state of the throttle valve by means of a fully-closed throttle valve position signal from a fully-closed throttle valve position detecting switch or an output of a throttle valve opening sensor. FIG. 7 shows, by way of example, a flow chart in this case.

As will be clear from the foregoing descriptions, in accordance with the method of this invention for controlling an internal combustion engine equipped with an electronic fuel injection system by correcting at least one control variable in accordance with at least one operating parameter, there is brought great advantages such that: by detecting the amount of the change of the at least one operating parameter at intervals of a given time period or a given engine crank angle and correcting the at least one control variable in accordance with the amount of the change of the operating parameter, the proportion of the change determined by the amount of the change and the magnitude of the operating parameter, or the rate of incremental change of the amount of the change or the proportion of the change obtained at intervals of a given time period or a given engine crank angle, it is possible to prevent variations of the engine rotational speed during the respective periods of idling and low speed operations; that by inhibiting the correction control of the at least one control variable at the start of the engine, at the start of the engine and during a predetermined time period after the start of the engine, or at the start of the engine and unitl a predetermined integrated number of engine revolutions is reached after the start of the engine, it is possible to prevent the engine starting performance from incurring adverse effects; and that by imposing restrictions on the conditions for effecting the correcting control in accordance with the engine speed and the intake pipe pressure, it is possible to prevent deterioration of the accelerability of the engine. Moreover, the internal combustion engine control method of this invention is featured in that this method does not have any adverse effect on any other engine performance and it is not affected by variations in the performance among respective engines, wear of engines, a change over time of the idling air flow rate of the engine, etc.

We claim:

1. A method for controlling an internal combustion engine having an electronically controlled fuel injection system comprising the steps of:

detecting a first operating parameter indicative of engine load and a second operating parameter indicative of engine speed;

computing a basic quantity of a control variable for controlling the operation of said engine in accordance with the detected first and second operating parameters;

determining whether said engine is under any of a plurality of specific operating conditions where correction of the basic quantity of said control variable is inhibited, said plurality of specific operating conditions of said engine including a starting period and a state in which said engine operates in a predetermined range of at least one of said first and second operating parameters;

upon determining that said engine is out of said specific operating conditions:

(1) subtracting a preceding value of said first operating parameter from a present value thereof to obtain a difference $\Delta P_m'$ occurring in a predetermined period, and subtracting a preceding value of said second operating parameter from a present value thereof to obtain a difference $\Delta N'$ occurring in the predetermined period, (2) computing a correction value of said control variable from the differences $\Delta P_m'$ and $\Delta N'$, and (3) correcting the basic quantity of said control variable by the correction value of said control variable thereby to stabilize the operation of said engine; and inhibiting the correction of the basic quantity of said control variable upon determining that said engine is under said specific operating conditions.

2. A control method according to claim 1, wherein said control variable of said engine includes at least one of a fuel injection quantity and ignition timing of said engine.

3. A control method according to claim 1 or 2, wherein said first operating parameter of said engine includes intake pipe pressure of said engine.

4. A control method according to claim 1, wherein said specific operating conditions of said engine includes the magnitude of said first operating parameter being greater than a predetermined value.

5. A control method according to claim 1, wherein said specific operating conditions of said engine includes the start of said engine along with a predetermined time period from the start of said engine.

6. A control method according to claim 1, wherein said specific operating conditions of said engine include a throttle valve of said engine not being fully-closed.

7. A control method according to claim 1, wherein said specific operating conditions of said engine includes said first operating parameter having two predetermined values to provide a hysteresis characteristic.

8. A control method according to claim 1, wherein said specific operating conditions of said engine includes the magnitude of the crankshaft rotational speed of said engine being greater than a predetermined value.

9. A control method according to claim 1, wherein said specific operating conditions of said engine includes the start of said engine along with a time period in which a predetermined integrated number of revolutions of said engine is reached after the start of said engine.

10. A control method according to claim 1, wherein said specific operating conditions of said engine includes said second operating parameter having two predetermined values to provide a hysteresis characteristic.

11. A control method according to claim 1, wherein the predetermined period is a predetermined time period.

12. A control method according to claim 1, wherein the predetermined period is a predetermined rotational angle of a crankshaft of said engine.

13. An apparatus for controlling an internal combustion engine equipped with an electronically controlled fuel injection system comprising:

first sensor means for detecting intake pipe pressure of said engine;

second sensor means for detecting a rotational speed of said engine;

injector means for supplying injection fuel to said engine; and computing means, having interconnected processing means, memory means and input/output means, for: (1) receiving detection signals from said first and second sensor means through said input/output means, (2) computing a basic value of a control signal for controlling the operation of said injector means, (3) determining whether said engine is under specified operating conditions where correction of the basic value of the control signal is inhibited, (4) computing a correction value for correcting the basic value of the control signal related to the changes in said detected signals over time from said first and second sensor means upon determining that said engine is out of said specified operating conditions, (5) when said specified operating conditions do not exist, correcting the basic value of the control signal by the correction value and supplying the corrected control signal to said injector means through said input/output means thereby to stabilize the operation of said engine, and (6) inhibiting the correction of the basic quantity of said control variable when said specified operating conditions do exist.

14. A control apparatus according to claim 13, wherein said processing means has interruption processing control programs stored in said memory means thereby to effect said determination, computation, correction and supplying in response to interruption command signals initiated by detection signals from said second sensor means.

* * * * *